US010703607B2

(12) United States Patent
Altenburger

(10) Patent No.: US 10,703,607 B2
(45) Date of Patent: Jul. 7, 2020

(54) METHOD FOR OPERATING A LIFT SYSTEM

(71) Applicants: THYSSENKRUPP ELEVATOR AG, Essen (DE); thyssenkrup AG, Essen (DE)

(72) Inventor: Bernd Altenburger, Neuhausen (DE)

(73) Assignees: THYSSENKRUPP ELEVATOR AG, Essen (DE); THYSSENKRUPP AG, Essen (DE)

( * ) Notice: Subject to any disclaimer, the term of this patent is extended or adjusted under 35 U.S.C. 154(b) by 354 days.

(21) Appl. No.: 15/550,404

(22) PCT Filed: Feb. 5, 2016

(86) PCT No.: PCT/EP2016/052484

§ 371 (c)(1),
(2) Date: Aug. 11, 2017

(87) PCT Pub. No.: WO2016/128313

PCT Pub. Date: Aug. 18, 2016

(65) Prior Publication Data

US 2018/0029827 A1 Feb. 1, 2018

(30) Foreign Application Priority Data

Feb. 13, 2015 (DE) ..... 10 2015 202 700

(51) Int. Cl.
*B66B 1/40* (2006.01)
*B66B 1/44* (2006.01)
(Continued)

(52) U.S. Cl.
CPC ..... *B66B 1/40* (2013.01); *B66B 1/44* (2013.01); *B66B 5/0018* (2013.01); *B66B 5/02* (2013.01); *B66B 9/00* (2013.01)

(58) Field of Classification Search
CPC ..... B66B 1/40; B66B 1/44; B66B 5/0018; B66B 5/02; B66B 9/00
(Continued)

(56) References Cited

U.S. PATENT DOCUMENTS 4,975,627 A * 12/1990 Reddy ..... B66B 1/32 187/288
5,155,305 A * 10/1992 Horbruegger ..... C23C 14/56 187/293
(Continued)

FOREIGN PATENT DOCUMENTS

CN 103204419 A 7/2013
JP H 06-064853 A 3/1994
(Continued)

OTHER PUBLICATIONS

English translation issued in PCT/EP2016/052484 dated Apr. 21, 2016 (dated May 3, 2016).
(Continued)

*Primary Examiner* — David S Warren
(74) *Attorney, Agent, or Firm* — thyssenkrupp North America, LLC

(57) ABSTRACT

A method for operating an elevator system with a car that moves in an elevator shaft may involve detecting an operating parameter related to a change in loading of the car, ascertaining whether a position of the car relative to a stopping floor needs to be adjusted based on the operating parameter, determining times at which the car is to be stopped and at which the adjustment is to be performed, stopping the car and blocking a flow of energy of a drive of the car and/or activating a service brake as the car is being stopped and/or while the car is stopped, and adjusting the
(Continued)

position of the car if necessary. Further, whether the adjustment is necessary may be ascertained before the car is stopped.

19 Claims, 2 Drawing Sheets

(51) Int. Cl.
*B66B 5/00* (2006.01)
*B66B 5/02* (2006.01)
*B66B 9/00* (2006.01)

(58) Field of Classification Search
USPC ..... 187/247
See application file for complete search history.

(56) References Cited

U.S. PATENT DOCUMENTS 5,693,919 A * 12/1997 Sager ..... B66B 5/027 187/282
7,360,630 B2 * 4/2008 Brant ..... B66B 1/40 187/284
10,252,879 B2 * 4/2019 Lotfi ..... B66B 1/36
2005/0230192 A1 * 10/2005 Brant ..... B66B 1/40 187/284
2011/0240412 A1 * 10/2011 Schienda ..... B66B 1/32 187/305
2013/0327598 A1 * 12/2013 Rebillard ..... B66B 1/44 187/280
2015/0014098 A1 * 1/2015 Stolzl ..... B66B 5/0031 187/248
2017/0174472 A1 * 6/2017 Lotfi ..... B66B 1/36
2018/0237261 A1 * 8/2018 Herkel ..... B66B 5/0031
2018/0312371 A1 * 11/2018 Wuthrich ..... B66B 1/3492
2018/0362297 A1 * 12/2018 Schoenauer ..... B66B 5/0018
2019/0202658 A1 * 7/2019 Lotfi ..... B66B 1/30

FOREIGN PATENT DOCUMENTS

JP 2005-206314 A 8/2005
JP 2013-119458 A 6/2013
KR 10-2011-0101472 A 9/2011
WO 2015119608 A 8/2015

OTHER PUBLICATIONS

Standard EN 81 "Safety rules for the construction and installation of lifts" 1998.
DIN EN 81-1, "Safety rules for the construction and installation of lifts, Part 1: Electric Lifts" Jun. 2010 (German Version).
DIN EN 81-2, "Safety rules for the construction and installation of lifts, Part 2: Hydraulic Lifts" May 2000 (English Version).

* cited by examiner

METHOD FOR OPERATING A LIFT SYSTEM

CROSS REFERENCE TO RELATED APPLICATIONS

This application is a U.S. National Stage Entry of International Patent Application Serial Number PCT/EP2016/052484, filed Feb. 5, 2016, which claims priority to German Patent Application No. DE 10 2015 202 700.7 filed Feb. 13, 2015, the entire contents of both of which are incorporated herein by reference.

FIELD

The present disclosure generally relates elevator systems, including methods for operating elevator systems.

BACKGROUND

Strict safety requirements which are set, inter alia, by different standards apply to elevator systems. Corresponding safety guidelines are provided, in particular, by standard EN 81 ("Safety rules for the construction and installation of lifts") from 1998 and the associated amendment A3 from 2009.

Point 12.7 of EN 81-1 relates to "Stopping the machine and checking its stopped condition". By way of example, it is required pursuant to point 12.7.3 ("A.C. or D.C. motor supplied and controlled by static elements") that "one of the following methods [shall] be used:

a) two independent contactors blocking the current to the motor. If, while the lift is stationary, one of the contactors has not opened the main contacts, any further movement shall be prevented, at the latest at the next change in direction of motion;

b) a system consisting of:

1. a contactor blocking the current at all poles. The coil of the contactor shall be released at least before each change in direction. If the contactor does not release, any further movement of the lift shall be prevented; and 2. a control device blocking the flow of energy in the static elements; and 3. a monitoring device to verify the blocking of the flow of energy each time the lift is stationary. If, during a normal stopping period, the blocking of the flow of energy by the static elements is not effective, the monitoring device shall cause the contactor to release and any further movement of the lift shall be prevented."

Accordingly, it is required, in particular, that a flow of energy is blocked at each stop with a subsequent reversal in the direction of travel of a car or cage of the elevator system, that is to say that a flow of energy of a drive of the car is blocked. In addition, it is necessary to check whether the flow of energy of the drive is also actually blocked. In particular, it is necessary for the contactors to be correspondingly checked for this purpose. A stop is, in particular, intended to be understood to mean that the car reaches a stopping floor and performs an operational stop there.

Further safety requirements relate to (position) adjustment of the car. Suspension cables from which the car is suspended constitute a spring system in the event of changes in the loading of the car. Lengths of the suspension cables can change in the case of different loadings in the car. If the load in the car increases (respectively decreases), the length of the suspension cables can increase (respectively decrease).

A change of this kind in the cable length during a stop can lead to the car not being level, in the case of which the position of the car in the elevator shaft relative to the stopping floor changes. Therefore, a step may be created between the door threshold of the car and the door threshold of the shaft, that is to say a step between the floor level of the car and the level of the stopping floor.

During the course of an adjustment, the car position relative to the stopping floor is regulated or adjusted. This can be done, for example, on the basis of an absolute positioning system. Adjustment of this kind ensures, for example, that the step between the door threshold of the car and the door threshold of the shaft does not exceed a permissible limit value.

For example, point 12.12 of the standard EN 81-1 requires a stopping accuracy of ±10 mm and an adjustment accuracy of ±20 mm.

A car usually stops after a fixedly prespecified movement procedure. As soon as the car comes to a standstill at the stopping floor, the car is stopped. A service brake is activated and the flow of energy is blocked during the course of this stoppage. The contactors are accordingly released and the drive is therefore deactivated.

The situation of the car not being level specifically on account of a change in load due to people entering or exiting said car is then monitored. The car position can be determined, for example, by means of position measurement sensors for this purpose. If an unlevel position is determined, adjustment is carried out. However, in this case, a specific switch-on cycle first has to be carried out in order to reactivate the drive of the car. The contactors are initially correspondingly actuated during the course of said switch-on cycle. A drive moment or motor moment of the drive is set in accordance with a current loading of the car. The current loading of the car is determined, for example by means of a load measurement sensor, for this purpose. The drive moment is accordingly adapted during the course of pilot torque control. When the corresponding drive moment is adapted, the service brake is released and the adjustment can be carried out.

In the case of switch-on cycles of this kind, it has proven problematical to subject the drive moment to precise pilot control and setting before the service brakes are released. Particularly in the case of a large change in load of the car over a short time period (for example when a large number of passengers leave and/or enter the car), the loading of the car cannot be precisely determined or at least is hard to precisely determine using a load measurement sensor. Accordingly, the drive moment also cannot be precisely set or is at least hard to precisely set. Therefore, when the service brake is released, the car may "jerk", that is to say the car may execute a noticeable, jerky movement.

A further problem that arises is that the adjustment can be carried out only with a certain delay. The switch-on cycle or each individual step of the switch-on cycle is accompanied by a time delay. Therefore, there is a considerable delay time between identifying the non-levelness and the adjustment being carried out. These delay times may be clearly noticed by passengers in the car and nevertheless steps can be created between the door threshold of the car and the door threshold of the shaft, these steps leading to an increased risk of tripping, even if said standard values are complied with. Elevator systems in which the service brakes are activated without the described blocking of the flow of energy during the course of stoppage of the car are also known/feasible.

Similar considerations apply to cable-free elevator systems, for example cars driven by linear drives, in an analogous manner and can be easily transferred to said cable-free elevator systems by a person skilled in the art.

Limit values for adjustment accuracy, as are required in EN 81-1 for example, usually represent a compromise between technical feasibility, according to which switch-on cycle and adjustment can be carried out, and a risk of tripping which is still acceptable in practice.

Therefore a need exists for carrying out an adjustment of a car position and blocking of a flow of energy and/or activation of a service brake of an elevator system in an improved and more efficient manner.

DETAILED DESCRIPTION

Figure 1:
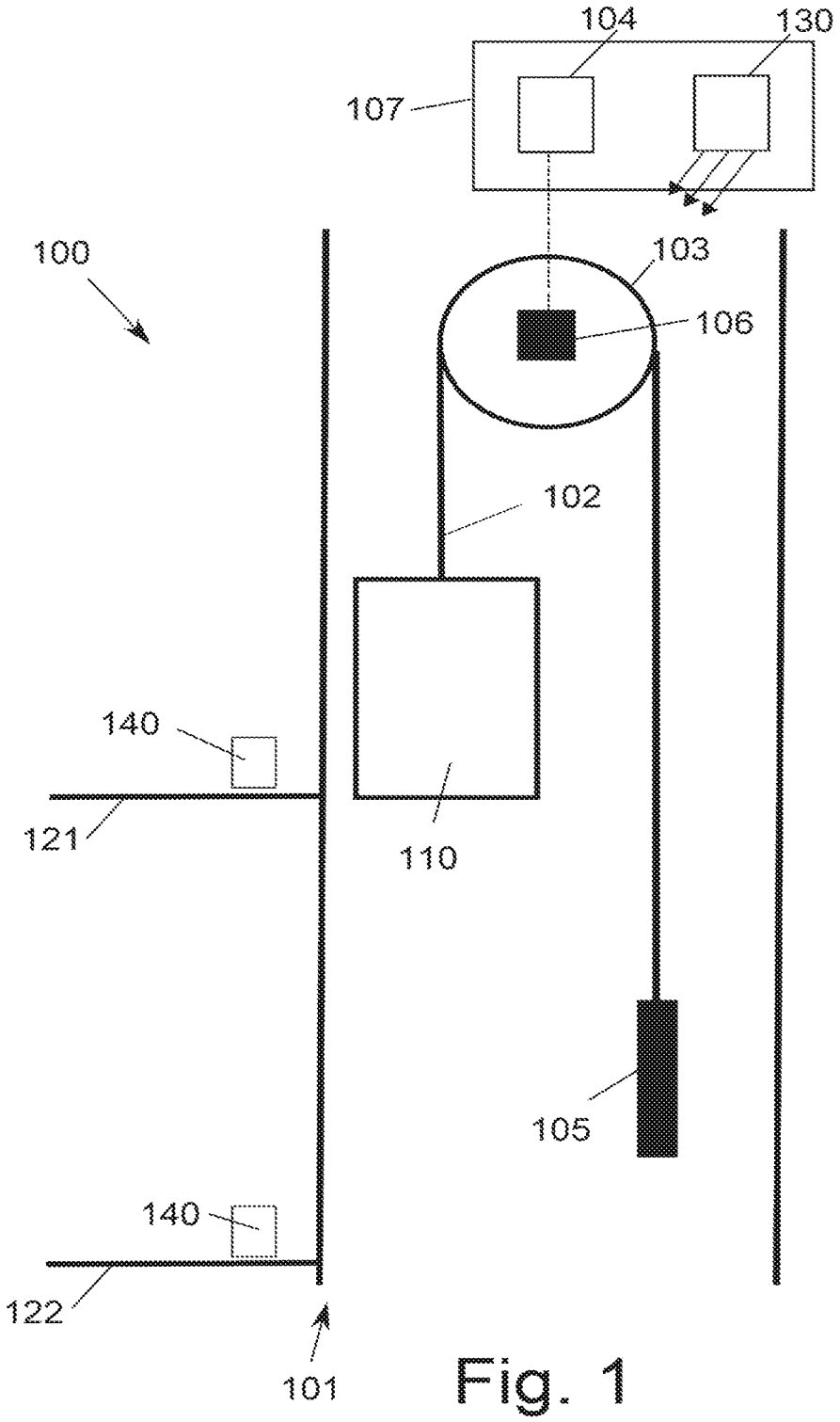
FIG. 1 is a schematic view of an example elevator system.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The present disclosure generally relates to methods for operating elevator systems that comprise a car that is moved in an elevator shaft, wherein the car stops at a stopping floor, wherein the car is stopped at the stopping floor and a flow of energy is blocked and/or a service brake is activated in the process, wherein, in the case of the flow of energy being blocked, a flow of energy of a drive of the car is blocked, and wherein, in the case of the service brake being activated, a service brake is activated, and wherein, if required, a car position of the car is adjusted to the stopping floor, wherein the car position in the elevator shaft relative to the stopping floor is set during the course of the adjustment.

The invention proposes a method for operating an elevator system and also a corresponding elevator system having the features of the independent patent claims. Advantageous refinements are the subject matter of the dependent claims and also of the following description.

The elevator system comprises a car which can be moved in an elevator shaft or a cage which can be moved in the elevator shaft. The car stops at a stopping floor. A stop is intended to be understood to mean, in particular, that the car reaches the stopping floor and performs an operational stop there. In particular, a stop is intended to be understood to mean the time interval between an arrival time, at which the car reaches the stopping floor, and a departure time, at which the car leaves the stopping floor.

The car is stopped at the stopping floor. A flow of energy is blocked and/or a service brake is activated during the course of this stoppage. In the case of the flow of energy being blocked, a flow of energy of a drive of the car is blocked. In the case of the service brake being activated, a service brake is activated. In particular, the service brake is activated first and then the flow of energy is blocked. As an alternative, the service brake can be activated without the flow of energy being blocked.

If adjustment is required, a car position is adjusted to the stopping floor. The car position in the elevator shaft relative to the stopping floor is set during the course of this adjustment. According to the invention, at least one operating parameter which relates to a change in loading of the car is detected. It is ascertained, depending on this detected at least one operating parameter at least before the car is stopped, whether adjustment to the stopping floor is required. This at least one operating parameter relates to or describes, in particular, a change in loading which has occurred in the car during the stop.

If it is ascertained that adjustment is required, the adjustment can be carried out, in particular, even before the car is stopped. As an alternative, the adjustment can also be carried out after the car is stopped.

In particular, the car position is regulated at an appropriate setpoint car position or stop position during the course of the adjustment. The flow of energy is blocked, in particular, in accordance with the standard EN 81, further particularly in accordance with point 12.7 of EN 81-1, explained in the introductory part. The drive of the elevator system, which drive can be embodied as a traction sheave drive for example, is connected to a power supply system, in particular by means of an expedient connecting circuit.

According to the standard EN 81-1, this connecting circuit can comprise, in particular, two contactors which are independent of one another, or further particularly a contactor, a control device and a monitoring device. In particular, during the course of blocking the flow of energy, a service brake is activated first and then the contactor or contactors is/are accordingly released and the drive is therefore deactivated.

The elevator system is not intended to be restricted to one car, but rather can also in particular be embodied as an elevator system comprising a plurality of cars (generally called a "multicar system"). By way of example, the elevator system can comprise two cars which can be moved in a common elevator shaft ("twin system").

The invention and its embodiments are suitable, in particular, for each car of an elevator system comprising a plurality of cars.

Owing to the invention, it is not necessary to stop after a fixedly prespecified movement procedure. Owing to the invention, the adjustment and blocking of the flow of energy can be matched to one another in an optimum manner. Depending on the current situation and depending on the requirement for adjustment ascertained, first the adjustment and then the blocking of the energy flow can expediently be carried out, or vice versa. The same applies, in addition or as an alternative to blocking the flow of energy, for activating the service brake, without this being explicitly mentioned in each case in the text which follows. In particular, when it is ascertained that adjustment is required, the adjustment is carried out before the flow of energy is blocked. In particular, the drive is not deactivated before the adjustment has been terminated.

In particular, the invention ensures that the flow of energy is blocked only once per stop as far as possible and not unnecessarily often. Since the operation of the contactors is associated with a high level of background noise, noise pollution in the machine room of the elevator system can be reduced. Furthermore, wear of the contactors can be reduced if the contactors are not operated unnecessarily often. Furthermore, wear of further components of the elevator system, for example of the drive and brakes, can be reduced. Nevertheless, it is possible to ensure that all standards in respect of blocking the flow of energy and adjustment are complied with, in particular the standard EN 81 explained in the introductory part.

Advantageously, the at least one operating parameter is detected and the requirement for adjustment is ascertained before the car stops, in particular before the car arrives at the stopping floor. In contrast to conventional elevator systems, a check is not first made at the stopping floor during the stop in order to determine whether the car position has changed so greatly that an adjustment has to be carried out. Instead, it has already been predictively ascertained before the stop whether such a case has occurred at the stopping floor. Therefore, it is determined as early as possible whether an adjustment will be required at the stopping floor.

When a requirement for adjustment is ascertained, the car is advantageously adjusted before it is stopped. When the adjustment is carried out before the car is stopped, the drive remains active, in particular initially, after the car reaches the stopping floor. Furthermore, in this case a corresponding stop drive moment is set at the drive in particular. The car position is, in particular, regulated at a corresponding setpoint car position or stop position during the course of the adjustment. If the car position changes on account of the non-levelness or on account of a corresponding change in load in the car, the adjustment is carried out automatically.

On account of the fact that the drive remains active in this case and the car position is regulated at the corresponding setpoint car position or stop position, the adjustment can be carried out automatically and as quickly as possible. The adjustment can therefore be carried out with a maximum possible degree of adjustment accuracy.

In order to carry out the adjustment, the drive of the car therefore does not first have to be activated out of a deactivated mode. Furthermore, it is, in particular, not necessary for a switch-on cycle to first be carried out before the adjustment can be carried out. Therefore, no delay times with which individual steps of the switch-on cycle are associated have to be taken into consideration. Therefore, a delay time between identifying the non-levelness and the adjustment being carried out is considerably reduced.

As explained in the introductory part, the problem that arises in the case of switch-on cycles of conventional elevator systems is that a drive moment cannot be precisely set or is at least hard to precisely set, and that when service brakes are released a jerky movement of the car can arise. In terms of regulation, it is generally considerably more difficult to adjust a stationary drive to a setpoint car position than to stop a running, active adjusted drive to a setpoint car position. Since the drive of the car can remain activated before an adjustment which is to be carried out, the adjustment can be carried out in a precise manner and with a high degree of driving convenience such that the drive and brake components are affected as little as possible. Since the drive is active and already adjusted before an adjustment which is to be carried out, "jumps" or jerky movements of the car can be prevented.

In particular, the situation of a step being created between the door threshold of the car and the door threshold of the shaft or a step being created between the floor level of the cage and the floor level of the stopping floor is therefore avoided. The risk of passengers tripping is avoided as well as possible.

In this case, the adjustment can be started, for example, immediately at the beginning of the stop once the car reaches the stopping floor. During the stop, the at least one operating parameter and/or further operating parameters of the elevator system can also be used to determine when the adjustment is started. To this end, these further operating parameters are detected, in particular, during the stop and these detected operating parameters are used during the stop to determine when the adjustment is necessary and when said adjustment is started. By way of example, a load and/or a change in load in the car can be monitored by means of a load measurement sensor as further operating parameters of said kind. As soon as the load and/or change in load in each case exceed a prespecified value, the adjustment is assessed as having been started.

The at least one operating parameter and/or the further operating parameters can be used during the stop to determine how long the adjustment is carried out for. As soon as, for example, the load and/or change in load in the car in each case fall below a prespecified value, the adjustment can be assessed, for example, as having been terminated.

In this case, the car can be stopped in particular immediately after the end of the adjustment. In particular, the flow of energy is blocked and/or the service brake is activated as soon as the adjustment is terminated. As an alternative, it is possible to also wait for a specific time interval after the end of the adjustment before the car is stopped.

Depending on the at least one detected operating parameter, an anticipated change in loading of the car is preferably ascertained. In particular, this predicted change in loading can be used to ascertain when the adjustment is started during the stop. In particular, it is also possible to ascertain how long the adjustment is carried out for. The car is preferably stopped after the adjustment in accordance with the ascertained anticipated change in loading.

In order to ascertain the requirement for adjustment, the at least one operating parameter is preferably subjected to comparison with a threshold value, in particular to comparison with a limit value. If the at least one operating parameter reaches a threshold value, it is ascertained, in particular, that adjustment is required.

A first change in load, by means of which a load of the car at the stopping floor is reduced, and/or a second change in load, by means of which the load of the car at the stopping floor is increased, are/is advantageously determined as the at least one operating parameter. Therefore, it is preferably already known before the beginning of the stop how the load of the car will change during the course of the stop at the stopping floor. Furthermore, it is possible to determine whether a non-levelness of the car occurs and/or the extent to which the car position relative to the stopping floor changes and whether an adjustment therefore has to be carried out, that is to say whether adjustment is required.

A first number of passengers who leave the car at the stopping floor and/or a second number of passengers who enter the car at the stopping floor are/is preferably determined as the at least one operating parameter. In particular, it is already known to the elevator system or the elevator controller, for example by way of the destination selection controller, before stopping commences how many passengers leave or enter the car during the course of the stop. Therefore, a corresponding change in load can be determined or extrapolated in particular. Operating parameters of this kind can be used, in particular, in passenger elevators. By way of example, in the case of goods or freight elevators, a load which is loaded into or removed from the car during the course of the stop can also be determined as a corresponding change in load or as an operating parameter.

It is preferably evaluated that adjustment is required or that the adjustment should be carried out when the first and/or the second change in load exceed/exceeds a respective limit value. As an alternative or in addition, it is evaluated that adjustment is required or that the adjustment should be carried out when the first number of passengers and/or the second number of passengers exceed/exceeds a respective limit value. In particular, these limit values are each selected in such a way that the non-levelness or the change in the car position relative to the stopping floor owing to the corresponding change in load does not exceed a corresponding maximum value. This prevents a step being created between the door threshold of the car and the door threshold of the shaft, that is to say between the floor level of the cage and the floor level of the stopping floor. Therefore, required standards can be complied with or even undershot for the purpose of increased safety since the regulation process can run in a considerably more dynamic manner.

When it is assessed that adjustment is required, the adjustment is advantageously carried out at a beginning of the stop and the car is stopped at an end of the stop. As an alternative, the car is advantageously stopped at the beginning of the stop and the adjustment is carried out at the end of the stop.

The beginning of the stop is intended to be understood to mean, in particular, a time at which the regular stopping of the car at the stopping floor begins. In particular, the beginning of the stop is intended to be understood to mean the arrival time at which the car reaches the stopping floor. Further particularly, the beginning of the stop is intended to be understood to mean an opening time at which the doors of the car open.

The end of the stop is intended to be understood as a time at which the regular stopping of the car at the stopping floor ends. In particular, it is intended to be understood as the departure time at which the car leaves the stopping floor. Further particularly, the end of the stop is intended to be understood to mean a closing time at which the doors of the car close.

When a requirement for adjustment is ascertained, the car is preferably adjusted from the beginning of the stop, during the entire stop, up until the end of the stop, and the car is stopped at the end of the stop. This embodiment can be used particularly when the adjustment is required during the entire stop. This is the case particularly when passengers continuously leave and/or enter the car during the stop and therefore changes in load which make an adjustment necessary take place in the car during the entire stop. By way of example, this is the case when both the first and the second change in load or both the first and the second number of passengers exceed the respective limit value.

According to a preferred embodiment of the invention, a first time, at which the adjustment is carried out, and a second time, at which the car is stopped, are determined when a requirement for adjustment is ascertained. This first and this second time are determined, in particular, depending on the at least one operating parameter of the elevator system. In particular, the first and the second time are determined before the car begins the stop.

Depending on whether the adjustment is carried out before or after the car is stopped, the first time can precede the second time; on the other hand the second time can also conversely precede the first time. When it is determined that no adjustment should be carried out, no first time is determined either. In this case, in particular, only the second time is determined.

In particular, the adjustment or the stoppage is started at said first or at said second time. It should be noted that a specific, fixed, absolute time is not necessarily actually determined as said first and said second time in each case. A time period during which the adjustment or the stoppage is carried out or during which the adjustment or the stoppage is started can in each case also be determined in particular as the first and the second time.

The first and the second times can each be flexible and can be selected depending on the current situation of the elevator system or on the requirement for adjustment ascertained. In particular, the blocking of the flow of energy and the stoppage can be carried out at the most favorable expedient times.

According to a preferred embodiment of the invention, a beginning of the stop is determined as the first time, at which the adjustment is carried out. In particular, the beginning of the stop is determined as the first time when the first change in load, the second change in load, the first number of passengers and/or the second number of passengers exceed the respective limit value. In particular, the at least one operating parameter and/or the further operating parameters are used to monitor when the adjustment is started starting from the first time point.

The second time, at which the car is stopped, preferably follows the end of the adjustment when the beginning of the stop is determined as the first time. The second time can, for example, immediately follow the end of the adjustment. As an alternative, it is also possible to wait for a specific time interval after the end of the adjustment before the car is stopped. An end of the stop is preferably determined as the second time when the beginning of the stop is determined as the first time.

According to an alternative preferred embodiment of the invention, the beginning of the stop is determined as the second time. In this case, the first time preferably follows the end of the blocking of the flow of energy. By way of example, the end of the stop can be determined as the first time in this case. When there is no requirement for adjustment, the beginning of the stop is preferably determined as the second time. In this case, no requirement for adjustment means that it is ascertained that adjustment is not required.

The requirement for adjustment is advantageously ascertained depending on the at least one operating parameter of the elevator system which is determined by means of a destination selection controller of the elevator system. The destination selection controller tells the elevator controller how many passengers leave the car and how many enter the car at the stopping floor during the course of the stop. Therefore, by evaluating call information from the destination selection controller, the first and the second number of passengers and furthermore the first and the second change in load can each be ascertained as operating parameters in particular.

If the evaluation of the destination selection controller information shows, for example, that the first and the second number each exceed a limit value at the stopping floor, that is to say that a comparatively large number of passengers leave and enter the car, the adjustment is preferably carried out before the car is stopped. In particular, the adjustment is carried out at the beginning of the stop and the stoppage is carried out at the end of the stop in this case. In particular, the beginning of the stop is determined as the first time and the end of the stop is determined as the second time. In this case, the car is, in particular, adjusted during the entire stop.

If the evaluation of the destination selection controller shows, for example, that the first and the second number do not exceed the possible limit value, that is to say that comparatively few or no passengers leave or enter the car, it is ascertained, in particular, that adjustment is not required. In this case, no adjustment is carried out. In this case, the car is preferably stopped at the beginning of the stop. In this case, the beginning of the stop is preferably determined as the second time.

As an alternative or in addition, the requirement for adjustment is ascertained depending on the at least one operating parameter of the elevator system which is preferably determined by means of an occupancy profile of the elevator system. An occupancy profile of this kind can be automatically learnt by the elevator system or by the elevator controller for example and/or can be established by means of statistical methods. As an alternative, the occupancy profile can also be prespecified and can describe, for example, known scenarios or known peak times.

An occupancy profile of this kind describes, in particular, the occupancy of the elevator system depending on specific times, for example depending on the time of day and/or the day of the week. The occupancy profile describes, in particular, the times (both in respect of the times of day and the day of the week) which are peak times.

A large number of stops at specific stopping floors occur at peak times of this kind. Examples of peak times of this kind are lunch traffic, up peaks and down peaks. During an up peak, the cars make a large number of stops at higher stopping floors, whereas said cars make a large number of stops at lower stopping floors during a down peak. During lunch traffic, a large number of stops are made in both directions, that is to say both at lower and at higher stopping floors.

During peak times, a large change in load in the car is very highly probable at these specific stopping floors. During peak times of this kind, the adjustment is preferably carried out in accordance with the above description relating to the beginning of the stop.

It may be advantageous when the method according to the invention is always carried out in a fixedly configured manner at a main stopping floor, for example the lobby, wherein, in particular, the flow of energy is blocked and/or the service brake is activated following the adjustment.

Said occupancy profile can be configured with a learning capacity, for example it can learn the occupancy depending on the time of day depending on days of the week or calendar days. Corresponding prespecifications are also possible in accordance with manual or automatic statistical evaluation. In the simplest case, manual configuration can also be performed depending on specific times of day and/or specific stops of the elevator system.

As an alternative or in addition, the requirement for adjustment is ascertained depending on the at least one operating parameter which is preferably determined by means of a person- and/or load-specific sensor signal. A person- or load-specific sensor signal of this kind is intended to be understood to mean a sensor signal which provides information about passengers or loads and is located in the car or at the stopping floor. To this end, an expedient sensor monitors, in particular, a region in front of the car at the stopping floor and/or the interior of the car itself. By way of example, an expedient camera as a sensor of this kind records an image signal and/or a video signal as a person- or load-specific sensor signal of this kind. By way of example, an optical sensor or especially an infrared sensor can also record an optical or infrared signal or an ultrasound sensor can record an ultrasound signal, which signals each allow load- or person-related statements to be made.

By monitoring the region in front of the car at the stopping floor in this way, the second change in load and/or the second number of passengers by which the load of the car at the stopping floor is increased can be determined in particular. Owing to the corresponding person- and/or load-specific sensor signals, it is possible to identify, for example, a load or freight which is intended to be loaded into the car at the stopping floor or the second number of passengers who wish to enter the car.

A sensor of this kind is preferably configured as a load measurement sensor (for example load cell or optical force/spring travel sensor) for measuring the load of the car. To this end, the load measurement sensor records a load measurement signal as the person- and/or load-specific sensor signal of this kind. The at least one operating parameter is preferably determined by means of a load measurement of this kind of the car. In particular, the current load in the car is determined as the at least one operating parameter.

A load measurement of this kind is suitable, for example, in goods or freight elevators. If the load measurement shows that the car is empty before reaching the stopping floor, this means that a load or freight will be loaded into the car at the stopping floor and therefore a second change in load will take place. In this case, the beginning of the stop is determined as the first time in particular.

If, on the other hand, the load measurement shows that the car is not empty before reaching the stopping floor, this means that a load or freight will be transported out of the car at the stopping floor and therefore a first change in load will take place. In this case, the beginning of the stop is determined as the first time in particular. As an alternative, in this case, the blocking of the flow of energy can firstly in particular also take place at the beginning of the stop and the adjustment can be carried out immediately after the end of the blocking of the flow of energy.

When the flow of energy is blocked during the stop, a check is preferably made to determine whether the flow of energy of the drive of the car is actually blocked. If this is not the case, any further movement of the car is, in particular, prevented for safety reasons in accordance with the standard EN 81.

The invention further relates to an elevator system comprising a car which can move in an elevator shaft. Refinements of this elevator system according to the invention can be found in the above description of the method according to the invention in an analogous manner. The elevator system according to the invention comprises a control unit, for example an elevator controller, which is designed to carry out one or more preferred embodiments of the method according to the invention.

Further advantages and refinements of the invention can be found in the description and the accompanying drawing.

It goes without saying that the features mentioned above and those still to be explained below can be used not only in the respectively indicated combination but also in other combinations or on their own, without departing from the scope of the present invention.

FIG. 1 schematically illustrates a preferred refinement of an elevator system according to the invention which is designated 100. A car 110 of the elevator system 100 can be moved in an elevator shaft 101. The car 110 is connected to a counterweight 105 by means of a suspension cable 102.

The car 110 is driven by a traction sheave drive 103 with motor 106. The traction sheave drive 103 is connected to a power supply system by means of an expedient connecting circuit. Said connecting circuit comprises two contactors 104 which are independent of one another, generally switching devices which are accommodated in the machine room 107.

The car 110 can be moved to several floors in the elevator shaft 101. Purely by way of example, FIG. 1 illustrates two floors 121 and 122. The elevator system comprises a destination selection controller. Input means 140, for example touchscreens or keypad input fields, are arranged at the different floors for a destination selection controller of this kind. Using these input means 140, passengers, at a starting floor at which they enter the car 110, can enter a destination floor to which they would like to be transported.

Figure 2:
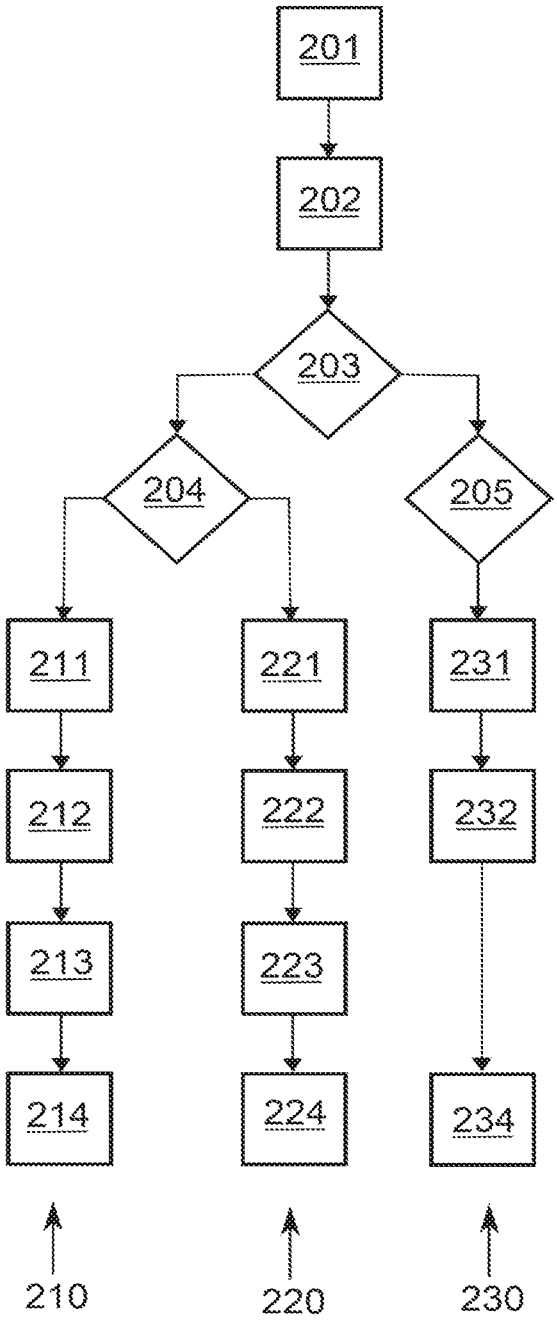
FIG. 2 is a block diagram of an example method of operating a lift system.

The elevator system comprises a control unit 130, for example an elevator controller. The elevator controller 130 is designed to carry out a preferred embodiment of a method according to the invention which is schematically illustrated as a block diagram in FIG. 2. The control unit 130 is accommodated in the machine room 107. Parts of the control unit 130 can also be located in the car 110.

In a first step 201, passengers at the starting floor 122 enter a destination floor using the corresponding input means 140. The elevator controller 130 receives a call. According to this call, the car 110 is intended to stop at the starting floor 122. In this case, the starting floor 122 is a corresponding stopping floor 122 at which people can already be located.

In step 202, operating parameters of the elevator system 100 which relate to a change in loading of the car 110 are determined by the elevator controller 130. In step 202, an anticipated first change in load, by which a load of the car 110 at the first stopping floor 122 is reduced, and an anticipated second change in load, by which the load of the car 110 at the stopping floor 122 is increased, are determined as operating parameters which relate to the change in loading of the car.

To this end, the elevator controller 130 evaluates information from the destination selection controller. Therefore, a second number of passengers who enter the car 110 at the stopping floor 122 is known to the elevator controller 130. Furthermore, a number of passengers who are currently in the car 110 and leave said car at the stopping floor 122 is known to the elevator controller 130. Using this first and second number of passengers, the elevator controller determines the first and the second change in load. Therefore, an anticipated change in loading of the car during the stop is ascertained in particular.

In step 203, the elevator controller 130 ascertains, depending on the specific operating parameters, whether adjustment is required at the stopping floor 122 and whether an adjustment of a car position should be carried out at the stopping floor 122. To this end, the operating parameters are in each case subjected to comparison with a threshold value. During the course of said comparison, the elevator controller 130 checks whether the first change in load and the second change in load each exceed a limit value.

In a first and a second case 210 and 220, the first and the second change in load exceed the respective limit value. In these cases 210 and 220, the elevator controller 130 evaluates that adjustment is required and that an adjustment should be carried out at the stopping floor 122.

In step 204, the elevator controller 130 determines whether the adjustment should be carried out before or after the car 110 is stopped. To this end, the elevator controller 130 determines a first time, at which the adjustment should be carried out, and a second time, at which the car 110 is stopped at the stopping floor 122.

In case 210, the adjustment is carried out before the car 110 is stopped. The determined first time therefore precedes the second time. In this example, a beginning of the stop is determined as the first time. An end of the stop is determined as the second time.

In step 211, the car 110 reaches the stopping floor 122 and doors of the car 110 are opened. The stop and the first time begin when the doors open.

In step 212, the adjustment is carried out at the beginning of the stop. During the course of the adjustment, the position of the car 110 in the elevator shaft 101 relative to the stopping floor 122 is set. To this end, the drive 103 of the car is correspondingly regulated.

At the end of the stop, the doors of the car 110 are closed again. At this second time, the car 110 is stopped in step 213.

During the course of said stoppage, in particular a service brake is activated first and then a flow of energy is blocked. For said blocking of the flow of energy, the contactors 104 are corresponding operated and the traction sheave drive 103 is deactivated. A check is then made to determine whether the traction sheave drive 103 is actually deactivated and the flow of energy of the traction sheave drive 103 is actually blocked.

The contactors 104 are then operated once again, so that the traction sheave drive 103 is activated again. The service brake is released and the car 110 leaves the stopping floor 122 in step 214.

In case 220, the adjustment is carried out after the car 110 is stopped. The determined second time therefore precedes the first time. The beginning of the stop is determined as the second time. An end of the blocking of the flow of energy is determined as the first time.

In step 221, the car 110 reaches the stopping floor 122 and doors of the car 110 are opened. The second time begins when the doors are opened and, in step 222, the car 110 is stopped at the beginning of the stop. Following the stoppage, the adjustment is carried out in step 223. At the end of the stop, the doors of the car 110 are closed again and, in step 224, the car 110 leaves the stopping floor.

In a third case 230, the first and the second change in load do not exceed the respective limit value. In this case 230, the elevator controller 130 assesses that adjustment is not required and adjustment should not be carried out. In said case 230, only the second time is determined in step 205. In this example, the beginning of the stop is determined as the second time. The car is therefore stopped at the beginning of the stop.

In step 231, the car 110 reaches the stopping floor 122 and doors of the car 110 are opened. The second time begins when the doors are opened and, in step 232, the service brake is activated and then the flow of energy is blocked. At the end of the stop, the doors of the car 110 are closed again and, in step 234, the car 110 leaves the stopping floor.

LIST OF REFERENCE SYMBOLS

100 Elevator system
101 Elevator shaft
102 Suspension cable
103 Traction sheave drive
104 Contactor, switching devices, service brake actuation means
105 Counterweight
106 Motor

107 Machine room
110 Car
121 Floor
122 Floor, stopping floor
130 Control unit, elevator controller
140 Input means, destination selection controller
201-205 Method steps
210-214 Method steps
220-224 Method steps
230-232, 234 Method steps

What is claimed is:

1. A method for operating an elevator system comprising a car that is moved in an elevator shaft, the method comprising:

detecting an operating parameter related to a change in loading of the car;

ascertaining whether an adjustment of a position of the car relative to a destination floor is necessary based on the operating parameter;

if the adjustment is ascertained to be necessary, determining a first time at which the adjustment is to be performed;

determining a second time at which the car is to be stopped;

determining the first and second times before bringing the car to rest at the destination floor, wherein each of the first and second times is determined relative to an absolute time or relative to a time period during which the car is at rest at the destination floor;

stopping the car at the destination floor by at least one of blocking a flow of energy of a drive of the car or activating a service brake; and if the adjustment is ascertained to be necessary, adjusting the position of the car to the destination floor whereby the position of the car in the elevator shaft relative to the destination floor is set, wherein whether the adjustment is necessary is ascertained before the car is stopped.

2. The method of claim 1 wherein detecting the operating parameter and ascertaining whether the adjustment is necessary occur before the car is brought to rest at the destination floor.

3. The method of claim 1 wherein if the adjustment is ascertained to be necessary the car is adjusted before the car is stopped.

4. The method of claim 1 further comprising ascertaining an anticipated change in loading of the car based on the detected operating parameter.

5. The method of claim 4 wherein the car is stopped after the adjustment in accordance with the anticipated change in loading that is ascertained.

6. The method of claim 1 wherein to ascertain whether the adjustment is necessary the operating parameter is compared to a threshold value.

7. The method of claim 1 wherein the operating parameter comprises at least one of:

a first change in load by way of which a load of the car at the destination floor is reduced;

a second change in load by way of which the load of the car at the destination floor is increased;

a first number of passengers that leave the car at the destination floor; or a second number of passengers that enter the car at the destination floor.

8. The method of claim 1 wherein if the adjustment is ascertained to be necessary, the car is adjusted from a beginning of the time period, throughout the time period, and up until an end of the time period, wherein the car is stopped at the end of the time period.

9. The method of claim 1 wherein a beginning of the time period corresponds to the first time, at which point the adjustment is performed.

10. The method of claim 1 wherein the second time follows an end of the adjustment.

11. The method of claim 1 wherein a beginning of the time period during which the car is at rest at the destination floor is determined as the second time, at which point the car is stopped.

12. The method of claim 1 wherein the first time, at which point the adjustment is performed, follows an end of a stop of the car.

13. The method of claim 1 wherein if the adjustment is ascertained to be unnecessary, a beginning of the time period is determined as the second time.

14. The method of claim 1 wherein the operating parameter is at least one of:

determined by way of a destination selection controller of the elevator system;

determined by way of an occupancy profile of the elevator system;

is fixedly configured and the adjustment is always performed at a predetermined destination floor;

determined by way of a person- and/or load-specific sensor signal; or determined by way of a load measurement of the car.

15. The method of claim 1 comprising limiting the stopping of the car to once per destination floor.

16. An elevator system comprising:

a car that is movable in an elevator shaft; and a control unit that detects an operating parameter related to a change in loading of the car, ascertains whether an adjustment of a position of the car relative to a destination floor is necessary based on the operating parameter, if the adjustment is ascertained to be necessary, determines a first time at which the adjustment is to be performed, determines a second time at which the car is to be stopped, determines the first and second times before bringing the car to rest at the destination floor, wherein each of the first and second times is determined relative to an absolute time or relative to a time period during which the car is at rest at the destination floor, stops the car at the destination floor by at least one of blocking a flow of energy of a drive of the car or activating a service brake, and if the adjustment is ascertained to be necessary, adjusts the position of the car to the destination floor whereby the position of the car in the elevator shaft relative to the destination floor is set.

17. The elevator system of claim 16 wherein the control unit is configured so as to stop the car only once per destination floor.

18. A method for operating an elevator system comprising a car that is moved in an elevator shaft, wherein the car is brought to rest at a destination floor;

wherein the car is stopped at the destination floor, the stopping of the car involving a flow of energy being blocked and/or a service brake being activated, wherein in a case of the flow of energy being blocked a flow of energy of a drive of the car is blocked;

wherein if adjustment is required a position of the car is adjusted to the destination floor, wherein the car position in the elevator shaft relative to the destination floor is set during a course of the adjustment;

wherein at least one operating parameter that relates to a change in loading of the car is detected;

wherein depending on the at least one operating parameter at least before the car is stopped, it is ascertained whether adjustment to the destination floor is required;

wherein if it is ascertained that adjustment is required, a first time at which the adjustment is carried out is determined, and a second time at which the car is stopped is determined before bringing the car to rest at the destination floor, and wherein each of the first and second times is determined relative to an absolute time or relative to a time period during which the car is at rest at the destination floor.

19. The method of claim 18 comprising limiting the stopping of the car to once per destination floor.

* * * * *